US005576814A

United States Patent [19]

Nishimura et al.

[11] Patent Number: 5,576,814

[45] Date of Patent: Nov. 19, 1996

[54] DEVELOPING UNIT USING TONER HAVING A MAGNETIC SHIELD BETWEEN THE AGITATION CHAMBER AND A DEVELOPING ROLLER

[75] Inventors: Soichiro Nishimura; Kazumasa Makino, both of Nagoya, Japan

[73] Assignee: Brother Kogyo Kabushiki Kaisha, Nagoya, Japan

[21] Appl. No.: 364,231

[22] Filed: Dec. 27, 1994

[30] Foreign Application Priority Data

Feb. 8, 1994 [JP] Japan ..... 6-014249
Apr. 19, 1994 [JP] Japan ..... 6-080080

[51] Int. Cl.[6] ..... G03G 15/09

[52] U.S. Cl. ..... 355/253; 118/657

[58] Field of Search ..... 355/251, 253; 118/657, 658

[56] References Cited

U.S. PATENT DOCUMENTS

| | | | |
|---|---|---|---|
| 4,026,241 | 5/1977 | Takebe et al. | 118/653 |
| 4,496,240 | 1/1985 | Yamashita et al. | 355/253 |
| 4,716,437 | 12/1987 | MacLellan | 355/218 |
| 4,822,711 | 4/1989 | Itaya et al. | 430/120 |
| 4,839,688 | 6/1989 | Bares | 355/253 |
| 4,993,829 | 2/1991 | Naganuma et al. | 355/251 |
| 5,196,890 | 3/1993 | Nakayama et al. | 118/657 X |

FOREIGN PATENT DOCUMENTS

| | | | |
|---|---|---|---|
| 0385865A3 | 9/1990 | European Pat. Off. . | |
| 0682297A2 | 11/1995 | European Pat. Off. . | |
| 3134354A1 | 4/1982 | Germany . | |
| 4-48232B | 3/1986 | Japan . | |
| 61-264368 | 11/1986 | Japan | 355/253 |
| 1-298382 | 12/1989 | Japan . | |

*Primary Examiner*—Joan H. Pendegrass
*Attorney, Agent, or Firm*—Oliff & Berridge

[57] ABSTRACT

A developing unit including a developing chamber provided with a rotatable developing sleeve and a magnet roller capable of rotating inside the developing sleeve, and a first agitator for agitating a developer, and an agitation chamber provided with a second agitator for supplying a magnetic toner to the developing chamber. A restriction member, formed of a magnetic material, is suspended between the developing chamber and the agitation chamber. A free end of the restriction member extends toward the first agitator and a toner supply slit is formed below the lower, or free, end of the restriction member so that the magnetic toner supplied by the second agitator in the agitation chamber is conducted to the first agitator without direct contact with the developing sleeve. As a result, the magnetic toner can be supplied and agitated positively and stably.

27 Claims, 4 Drawing Sheets

DEVELOPING UNIT USING TONER HAVING A MAGNETIC SHIELD BETWEEN THE AGITATION CHAMBER AND A DEVELOPING ROLLER

BACKGROUND OF THE INVENTION

1. Field of the Invention

The invention relates to a developing unit in a xerographic type image forming apparatus used in a printer, a copying machine, a facsimile device, or the like and, more particularly, to a structure of a developing unit capable of supplying a developer so as to improve the image quality.

2. Description of the Related Art

Heretofore, as a developing unit wherein a two-component developer, composed of a toner and a magnetic carrier, is fed for development to a developing area on the surface of a photosensitive drum, there has been known, for example, a developing unit such as disclosed in Japanese Patent Publication No. Hei 4-48232. According to this conventional developing unit, a developing roller is disposed within a vacant chamber adjacent to the photosensitive drum, the developing roller comprising a developing sleeve adapted to rotate about a horizontal axis and a magnet roller having N and S poles magnetized alternately in the circumferential direction on the inner diameter side of the developing sleeve, the magnet roller being rotated in the direction opposite to the rotating direction of the developing sleeve to form a magnetic brush on the sleeve surface, thereby feeding the developer to the drum surface, while downstream in the toner conveying direction by the developing sleeve in the vacant chamber there is disposed a trimmer blade for restricting the height of the magnetic brush and hence the layer thickness of the developer.

The vacant chamber and a toner supply chamber provided with a toner agitating member are partitioned using upper and lower partition plates. In a stagger portion between the upper and lower partition plate edges is a toner supply slit extending in the axial direction of the developing sleeve. The toner supply slit is formed within an area where the magnetic field induced by the magnet roller extends. Within the vacant chamber, the toner which is supplied through the toner supply slit and a magnetic carrier pre-stored in the vacant chamber are agitated in the axial direction of the developing sleeve by means of fins formed on the inner surface of the upper partition plate, whereby an initial developer (initial toner, which is a mixture of magnetic carrier and toner), fed beforehand into the vacant chamber, adheres to the outer peripheral surface of the developing sleeve to form a magnetic brush of a predetermined height on the sleeve. For the formation of the image, toner is supplied from the toner supply chamber side.

In the above construction, however, when the toner to be supplied has magnetism and the partition plates are formed of a non-magnetic material that easily conducts magnetism (less magnetism shielding property), such as a synthetic resin, and when the magnetic toner in the toner supply chamber is fed into the vacant chamber through the toner supply slit by means of the toner agitating member, the action of magnetism from the magnet roller reaches the magnetic toner on the opposite side (the toner supply chamber side) through the partition plate wall portion so that the magnetic toner is attracted magnetically to, for example, the wide surface of the partition plate on the toner supply chamber side and is held there. As a result, the clearance of the toner supply slit between the upper and lower partition plates is narrowed by the magnetic toner attracted and held as described above. Consequently, it becomes difficult to convey the toner to the vacant chamber side, hence deteriorating the effect of replenishing the developing roller with a predetermined amount of toner. Further, there has been another problem such that the toner deposited on the inner surface of each partition plate solidifies due to being held over a long period.

Additionally, by only forming fins on the inner surface of the upper partition plate, the frictional charging action induced by the agitation of toner and carrier in the vacant chamber has been incomplete.

SUMMARY OF THE INVENTION

The invention has been accomplished for solving the above-mentioned technical problems of the prior art. It is the object of the invention to provide a developing unit capable of supplying a magnetic toner smoothly to a chamber having a developing roller and also capable of improving both a developer agitating action and image quality.

According to a first aspect of the invention, in order to achieve the above-mentioned object, in a developing unit including a developing chamber provided with a developing roller, the developing roller comprising a developing sleeve adapted to rotate while carrying a developer on the surface thereof and a magnet roller adapted to rotate on the inner diameter side of the developing sleeve; a first agitator means for agitating the developer which is a mixture of a magnetic toner and a magnetic carrier in the developing chamber; and an agitation chamber provided with a second agitator means for supplying the magnetic toner to the developing chamber, there is used a restriction member formed of a magnetic material, the restriction member being mounted in a suspended state between the developing chamber and the agitation chamber so that an intermediate portion thereof is opposed to the peripheral surface of the developing roller in the developing chamber and a free end thereof extends toward the first agitator means.

According to a second aspect of the invention, in the developing unit according to the first aspect of the invention described above, the restriction member is formed in the shape of a plate and is so mounted that a wide surface thereof is positioned along and nearly in parallel with the peripheral surface of the developing roller.

According to a third aspect of the invention, in the developing unit according to the first or second aspect of the invention, the spacing between the wide surface of the restriction member and the peripheral surface of the developing sleeve is set in such a manner that a magnetic brush of the magnetic carrier created by a magnetic field of the magnet roller is not bridged on the wide surface of the restriction member and the magnetic toner can be attracted to the surface of the developing sleeve.

DESCRIPTION OF THE PREFERRED EMBODIMENT

Figure 1:
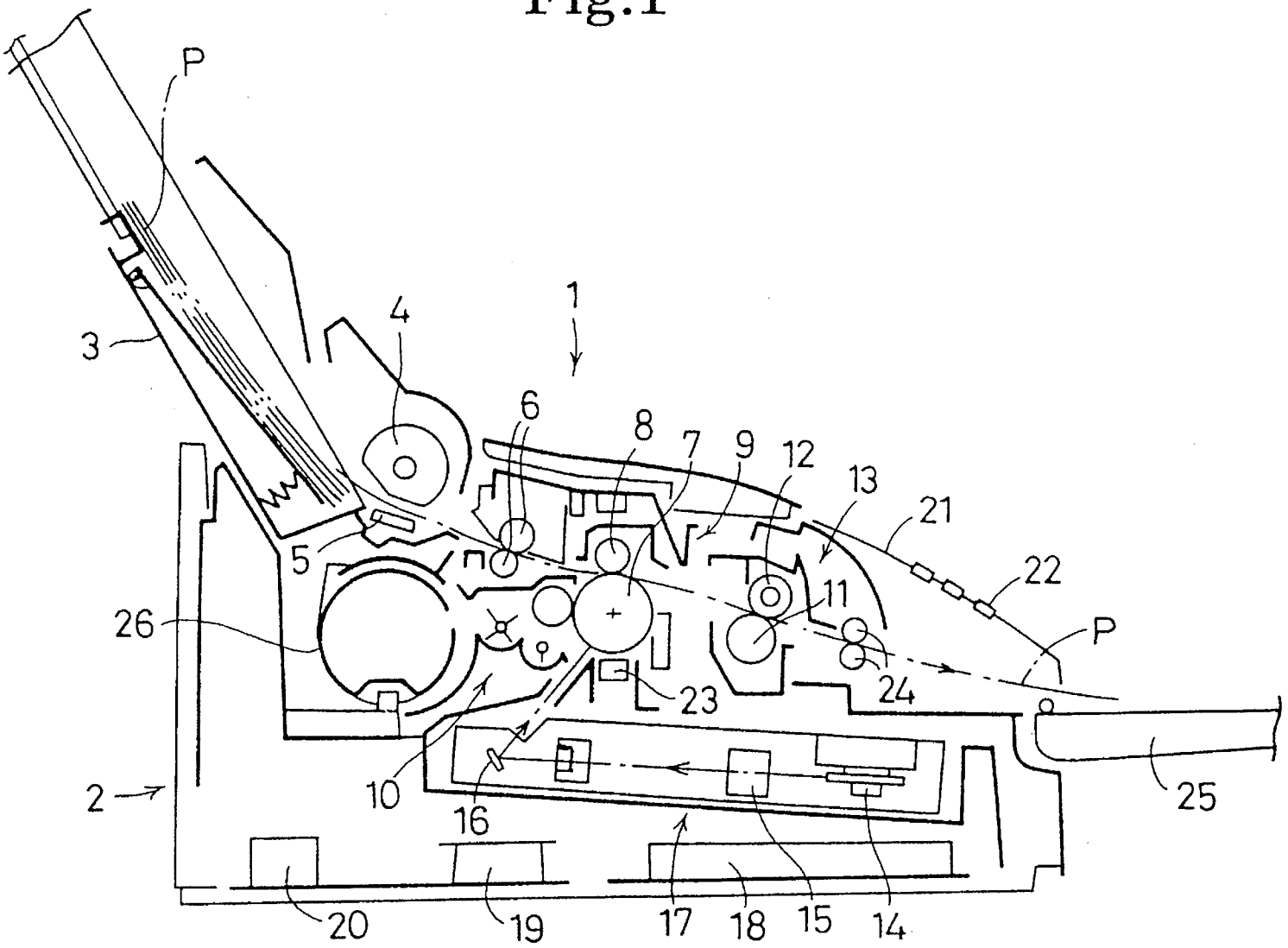
FIG. 1 is a schematic sectional side view of a laser printer.
Figure 2:
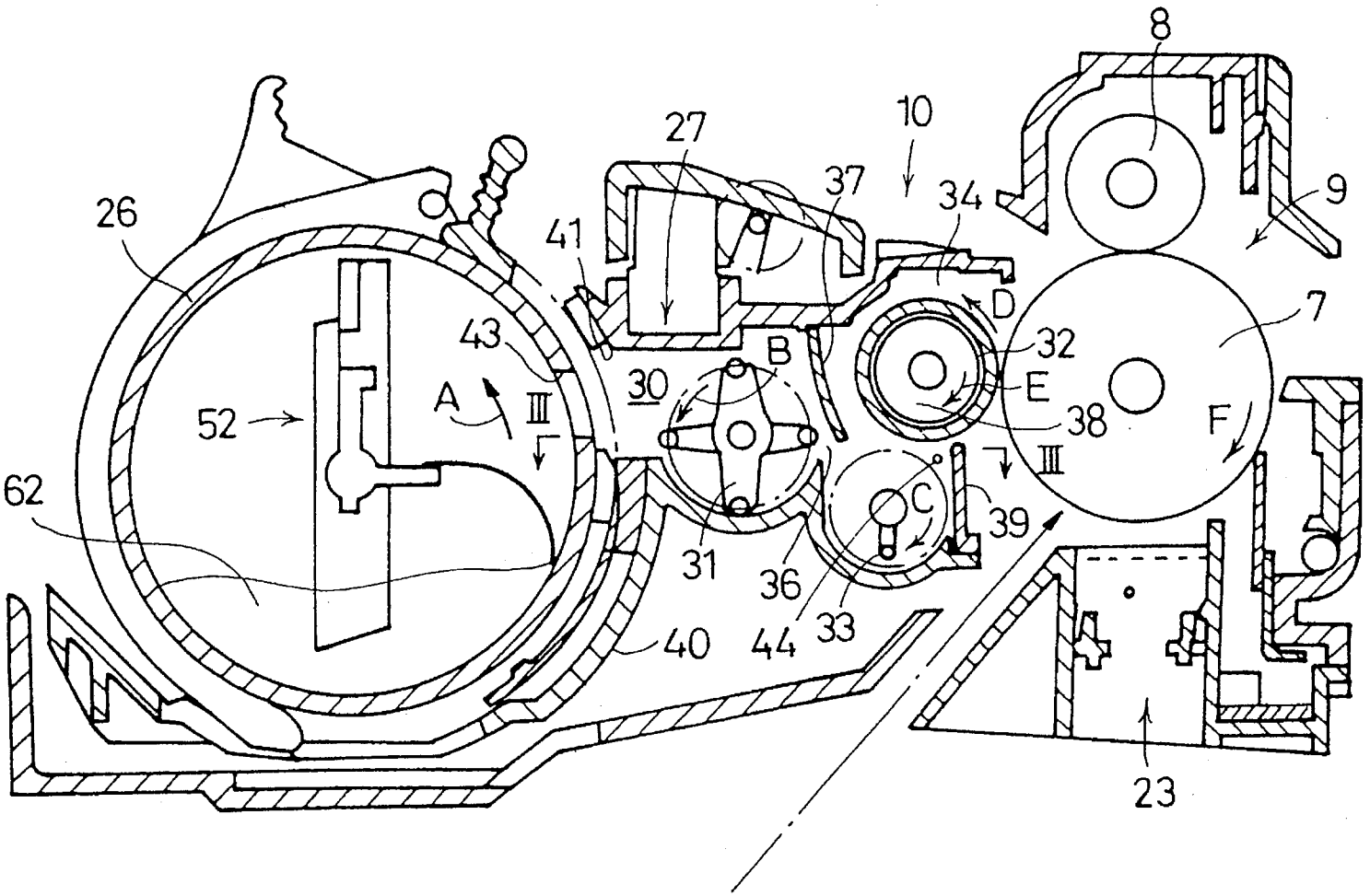
FIG. 2 is a partially cut-away, sectional side view of a principal portion of a developing unit embodying the invention.
Figure 3:
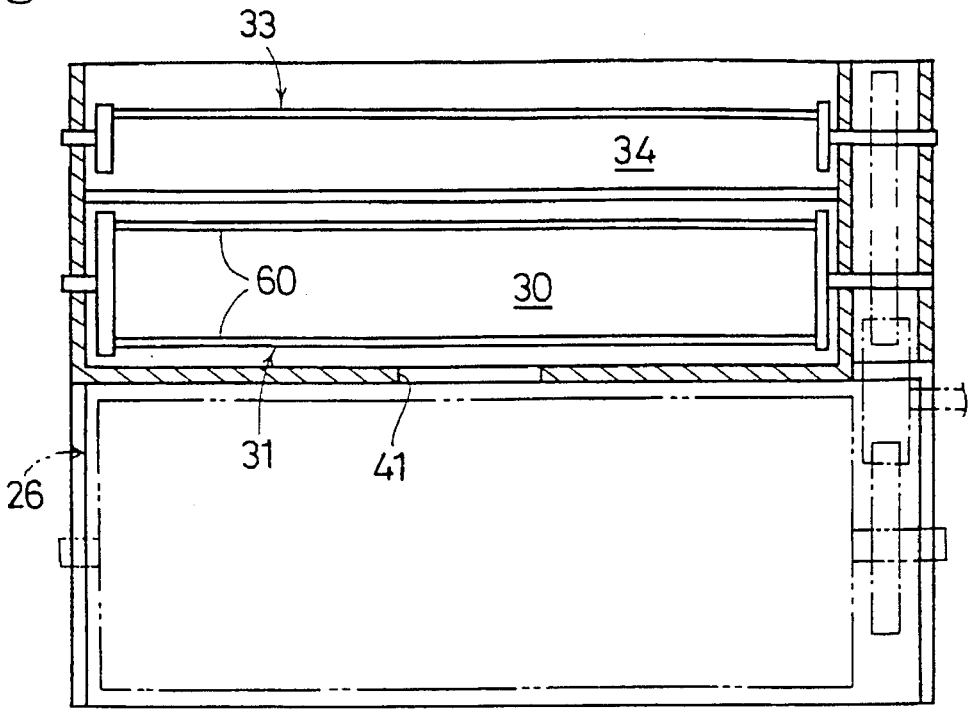
FIG. 3 is a view as seen in the arrowed direction III—III in FIG. 2.

An embodiment of the invention will be described in detail hereinunder with reference to the accompanying drawings. FIG. 1 is a schematic sectional side view of a printer 1 as an image forming apparatus and FIG. 2 is a partially cut-away sectional view of a developing unit 10 embodying the invention.

In the printer 1, a paper feed cassette 3 is mounted removably in an upper position on one side of a body case 2. The plural sheets of paper P, stacked as recording media within the cassette 3, are separated one by one by means of a paper feed roller 4 and a separating pad 5 and fed through a pair of delivery rollers 6 to a photoreceptor unit 9 comprising a photosensitive drum 7 and a transfer roller 8. The developing unit 10, which will be described later, is disposed adjacent to the photoreceptor unit 9 and on the side closer to the paper feed cassette 3. Disposed on the opposite side of the photoreceptor unit 9 is a fixing unit 13 comprising a heating roller 11 and a pressing roller 12.

Disposed below the photoreceptor unit 9 are a scanner unit 17 comprising a laser oscillator 14, a lens 15 and a reflecting mirror 16; control substrates 18,19; and a power unit 20. A keyboard 22 having a plurality of operating buttons is provided in a cover 21.

In accordance with image data provided from an external device, such as a computer (not shown), light emitted from the scanner unit 17 is irradiated onto the surface of the photosensitive drum 7, which has been electrically charged beforehand by an electric charger 23, to form an electrostatic latent image on the surface of the drum 7. Then, development is performed, that is, the latent image is made into a visible image, by the supply of a powdered developer which has been magnetized with rotation of a horizontally extending, developing sleeve 32 in the developing unit 10 as will be described later. Thereafter, the above developer image is transferred onto the paper P fed between the photosensitive drum 7 and the transfer roller 8, followed by the application of heat and pressure to the transferred image in the fixing unit 13 to fix the image on the paper.

The paper P is discharged between a pair of discharge rollers 24 onto a discharge tray 25 in the printer 1.

Description is now directed to the structure of the developing unit 10 with reference to FIG. 2. Within a developing case 27, formed of a synthetic resin or the like, in the developing unit 10 are formed an agitation chamber 30 and a developing chamber 34 as a developing portion, the chambers 30,34 are adjacent to each other as shown in FIG. 2.

On the upper side, in the interior of the developing chamber 34, is disposed a developing roller comprising a cylindrical developing sleeve 32 formed of a non-magnetic material such as aluminum and a magnet roller 38 disposed radially inward of the developing sleeve 32 and having N and S poles magnetized alternately in the circumferential direction. Below the developing sleeve 32 is a first rotary agitator 33 as the first agitator means. The developing sleeve 32 is rotatably positioned so that a portion of its peripheral surface opposes the outer peripheral surface of the photosensitive drum 7. The first rotary agitator 33 comprises a single round bar of a non-magnetic material having a length approximately equal to that of the developing sleeve 32, both ends of the round bar are bent in crank form with the ends of the bent portions serving as the center of rotation.

A trimmer blade 39 projects upward from the bottom of the developing chamber 34 to a position to one side of the outer peripheral surface of the photosensitive drum 7 so that the free end (upper end) of the trimmer blade 39 faces the outer peripheral surface of the developing sleeve 32. The spacing from the developing sleeve 32 adjusts the layer thickness of the electrically charged developer on the surface of the developer sleeve 32.

Interposed between the developing chamber 34 and the agitation chamber 30 is a restriction member 37. The restriction member 37 is suspended from the ceiling surface of the developing case 27. The length of the restriction member 37 is approximately equal to the diameter of the developing sleeve 32. As a result, a toner supply slit 36, open in the longitudinal direction of the first rotary agitator 33, is formed between the lower edge of the restriction member 37 and the bottom of the developing case 27. The restriction member 37 is formed in the shape of a plate of a magnetic material functioning as a magnetic shielding material, such as pure iron, Permalloy (iron-nickel alloy), soft ferrite or Fe-B amorphous alloy. An intermediate portion of the wide surface of the restriction member 37 extends downward into the developing chamber 34 and is offset from the outer peripheral surface of the developing sleeve 32. The restriction member 37 is disposed so that its free end is in proximity to the periphery of the rotation path of the first rotary agitator 33.

The wide surface of the restriction member 37 (FIG. 4) is curved over a suitable range H in a generally arcuate shape in side view so as to be substantially in parallel with the outer peripheral surface of the developing sleeve 32. Further, a suitable spacing L1 is set between the wide surface of the restriction member 37 and the outer peripheral surface of the developing sleeve 32 so that a magnetic brush 35 of the magnetic carrier created by the magnetic field of the magnet roller 38 is not bridged over the wide surface of the restriction member 37 and the outer peripheral surface of the developing sleeve 32.

In this embodiment, if the diameter of the developing sleeve 32 is 16 mm and the magnetic flux density (field intensity) of the magnet roller 38 is $7\times10^{-2}$ to $7.5\times10^{-2}$ T (unit: Tesla=Wb per $m^2$), the spacing L1 is set at about 3 to 5 mm, preferably 4 mm.

On the other hand, the spacing L2 between the lower end of the restriction member 37 and the periphery of the rotation path of the first rotary agitator 33 is set at about 1 to 1.5 mm.

Figure 4:
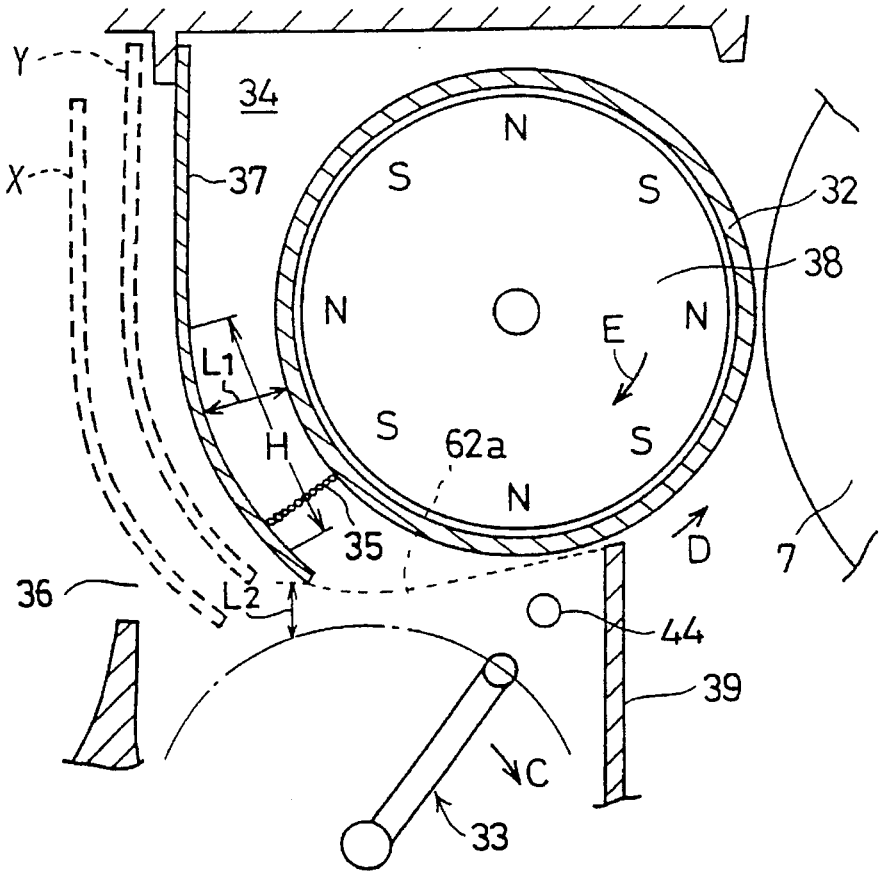
FIG. 4 is an enlarged sectional view of a principal portion of the interior of a developing chamber.

Further, a stationary agitator 44 formed of a magnetic material, such as pure iron, Permalloy (iron-nickel alloy) or soft ferrite, is disposed within the developing chamber 34 in a region bounded by a position close to the upper end of the inner surface of the trimmer blade 39, the lower peripheral surface portion of the developing sleeve 32, and the periphery of the rotation path of the first rotary agitator 33. As an example, the stationary agitator 44 is disposed substantially in parallel with the axis of the developing sleeve 32, as shown in FIGS. 2 and 4.

Along the side face of the agitation chamber 30, opposite to the developing chamber 34, is a partition wall 40 having a generally arcuate section. A toner box 26 is disposed face to face with the partition wall 40. A toner inlet 41 in the partition wall 40 is formed on the agitation chamber 30 side. The toner inlet 41 is almost the same shape as a toner outlet 43 formed in the toner box 26. Magnetic toner 62 is discharged through a third agitator 52 which rotates in the direction of arrow A within the toner box 26 and is supplied through the toner inlet 41 to the agitation chamber 30.

A second rotary agitator 31, the second agitator means, extends parallel to the horizontal axis of the developing sleeve 32 and rotates in the direction of arrow B, within the agitation chamber 30, to rake the magnetic toner 62 from the bottom of the agitation chamber 30 toward the toner supply slit 36. At this time, the toner 62, which has been fed from the toner inlet 41 to a longitudinally intermediate portion of conveyance members 60 of the second rotary agitator 31 is distributed in the longitudinal direction (toward both ends) of the conveyance members 60 by the rotation of the conveyance members 60 so that, in the portion of the toner supply slit 36, the toner 62 is conveyed uniformly in the longitudinal direction of the conveyance members 60 and is fed into the developing chamber 34.

The first rotary agitator 33 rotates in the direction of arrow C. While agitating both the toner 62 thus fed and a magnetic carrier pre-stored in the developing chamber 34, the first rotary agitator 33 causes the toner-carrier mixture to move toward the underside of the developing sleeve 32. The developing sleeve 32 rotates in the direction of arrow D and the magnet roller 38, disposed within the sleeve 32, rotates in the direction of arrow E. The photosensitive drum 7 rotates in the direction of arrow F.

The developer method used in this embodiment may be either a so-called two-component type composed of 95–98% (by weight) of magnetic carrier and 5-2% (by weight) of non-magnetic toner, or a so-called 1.5-component type composed of 30–80% (by weight) of magnetic carrier and 70-20% (by weight) of magnetic toner.

The operation of this embodiment structured as described above will now be described. As shown in FIG. 4, the magnetic toner 62 fed from the agitation chamber 30 comes into contact with the wide back (opposed to the second rotary agitator 31) of the restriction member 37. However, since the restriction member 37 is formed of a magnetic material having an electromagnetic shielding property, the magnetic field from the magnet roller 38 is shielded by the restriction member 37, so that the magnetic toner 62 fed from the agitation chamber 30 drops toward the first rotary agitator 33 without attractive retention on the restriction member 37 and is, thus, supplied into the developing chamber 34.

Within the developing chamber 34, the toner and the magnetic carrier are agitated by the rotation of the first rotary agitator 33 and at the same time the magnetic toner 62 is charged by friction. The magnetic 62 toner thus charged is suspended under the action of the rake-up magnetic force of the first rotary agitator 33 and of the magnet of the magnet roller 38. The toner 62 then adheres onto the magnetic carrier by being attracted by the magnet roller 38 and held on the surface of the developing sleeve 32. With rotation of the sleeve 32, the developer now assuming such a state is transferred in the direction of the arrow D and into the developing region where the sleeve 32 and the photosensitive drum 7 are opposed to each other while the layer thickness of the electrically charged developer is restricted by the upper end portion of the trimmer blade 39.

Thus, as mentioned above, a predetermined amount of the magnetic toner 62 can be supplied steadily from the agitation chamber 30 toward the first rotary agitator 33 in the developing chamber 34. By agitating the magnetic toner 62 with the first rotary agitator 33 it is possible to maintain the mixing ratio of magnetic carrier and magnetic toner 62 at an appropriate value and hence possible to appropriately control the amount of magnetic toner 62 moved (scattered) to the surface of the photosensitive drum 7 in the developing region, whereby there can be obtained a "sharp" image and the portion to be white remains white as a toner-free portion. If the amount of scattered toner is large, the toner will be deposited on the portion meant to be white, the portion becoming gray. Thus, the image obtained is poor in "sharpness."

In the radially outside portion from the surface of the developing sleeve 32 there is generated a magnetic field as magnetic line of force starting from N pole and ending at S pole which are magnetic poles of the magnet roller 38 disposed on the inner diameter side of the sleeve 32. Along the magnetic line of force, the magnetic carrier is arranged substantially linearly to form a magnetic brush 35. As shown in FIG. 4, since the magnet roller 38 rotates in the direction of the arrow E and the developing sleeve 32 rotates in the opposite direction (arrow D), the magnetic carrier (magnetic brush 35) on the sleeve surface moves in the direction of the arrow D in a flip-flopping movement pattern (i.e., from the radial position shown in FIG. 4, to substantially parallel to the circumference of developing sleeve 32 and back to a radial position depending on the magnetic lines of force).

As mentioned previously, the surface of the restriction member 37, formed of a magnetic material, is magnetized by the magnetism of the magnet roller 38 so if the spacing L1 between the surface of the developing sleeve 32 and that of the restriction member 37 is too narrow, even if that portion is local, the magnetic brush 35 of the magnetic carrier will be bridged over both the sleeve surface and the restriction member surface, as shown in FIG. 4 and the bridged position of the magnetic brush 35 may be maintained constant and assume a stable state despite rotation of the developing sleeve 32. In this case, there is formed a linear black line image in the rotating direction on the circumferential surface of the developing sleeve 32 and also on the circumferential surface of the photosensitive drum 7. Therefore, consideration should be given to setting the spacing L1 at an appropriate value.

If the spacing L1 is widened, while keeping constant the spacing L2 (shown in dashed lines in FIG. 4 as position X) between the lower end (free end) of the restriction member 37 and the periphery of the rotation path of the first rotary agitator 33, the lower end of the restriction member 37 shifts downward, so that the toner level, indicated at **62*a*, in the developing chamber 34 also goes down. As a result, the magnetic field of the magnet roller 38 no longer exerts an appropriate influence on the magnetic toner 62, in other words, an appropriate amount of toner 62 is not attracted to the surface of the developing sleeve 32, and hence the image quality is deteriorated. If the spacing L1 is widened while keeping constant the toner level 62*a*, namely, the lower end position of the restriction member 37 (shown in dashed lines in FIG. 4 as position Y), the spacing L2 becomes wider, and with rotation of the first rotary agitator 33, the amount of toner passing through the space between the upper end of that agitator and the lower end of the restriction member 37 and raked up toward the developing sleeve 32 increases. At this time, the ratio of the magnetic toner to the carrier becomes higher because the lower end of the restriction member 37 is close to the toner supply slit 36**, resulting in an obtained image that is poor in "sharpness." Such should be avoided.

Further, if the spacing L1 is widened, the passage on the back side of the restriction member 37 becomes narrower, so it is required to enlarge the whole of the developing case 27 in order to ensure a certain size of that passage. In the latter case mentioned above, if the radius of the first rotary agitator 33 is made larger to diminish the spacing L2, it is also required to enlarge the whole of the developing case 27. Here again, a drawback is encountered.

By making the spacing L1 appropriate, as described above, it is possible to not only form a good image but also to reduce the size of the developing unit 10.

If the length of the restriction member 37 and that of the developing sleeve 32 are made almost equal to each other and if both are arranged concentrically so as to keep substantially constant the spacing L1 between the developing sleeve 32 and the restriction member 37, the agitating action of the first rotary agitator 33 for the magnetic toner 62 can be exerted substantially uniformly throughout the overall length of the developing sleeve 32 and therefore there will be no unevenness in the image obtained in the longitudinal direction of the developing sleeve.

Figure 5:
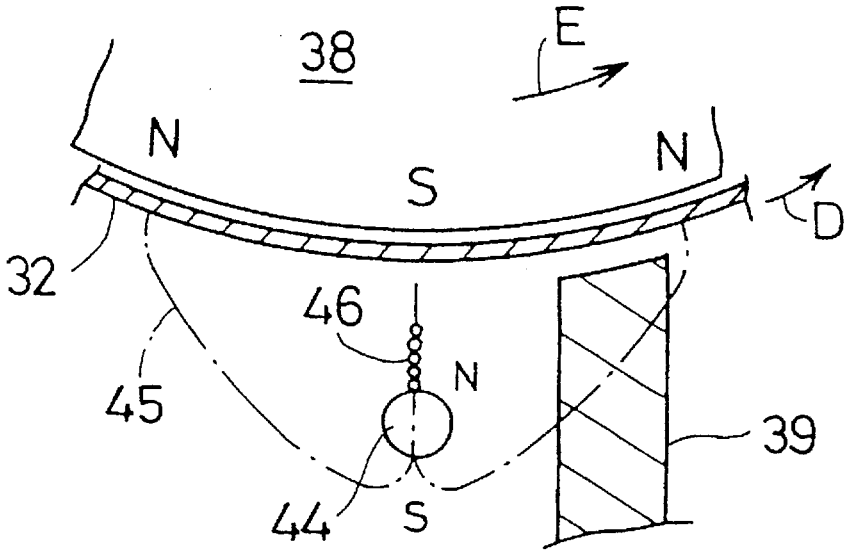
FIG. 5 is an operational view.

When the magnet roller 38 rotates in the direction of the arrow E, as shown in FIG. 4, the magnetic poles of the magnet roller 38 change successively in their approach position relative to the stationary agitator 44. Consequently, on the stationary agitator 44 side, which is formed of a magnetic material, there is oriented a magnetic force line 45 (see FIG. 5) so that there appears a magnetic pole (e.g., S pole) opposite to the closest pole (e.g., N pole) of the magnet roller 38. Along the magnetic force line 45 is formed a magnetic brush 46 of the magnetic carrier on the surface of the stationary agitator 44. The direction and length of the magnetic brush 44 vary continually in accordance with the rotation of the magnet roller 38.

Consequently, the magnetic carrier which has been scraped from the surface of the developing roller 32 by the upper end portion of the trimmer blade 39 moves onto the surface of the stationary agitator 44 in accordance with changes in the magnetic force line and moves around the peripheral surface of the agitator 44. The result is that the magnetic toner 62 is also agitated, whereby the magnetic carrier and the magnetic toner 62 can be prevented from being solidifying on the inside surface of the trimmer blade 39 (the developing chamber 30 side).

The stationary agitator 44 is positioned outside the periphery of the rotation path of the first rotary agitator 33, the toner 62 located in the region defined by the upper end portion of the trimmer blade 39 and the lower portion of the developing sleeve 32, and within the influencing range of the magnetic field of the magnet roller 38, can be agitated efficiently in the presence of the magnetic carrier (magnetic brush) deposited on the stationary agitator 44 after being scraped off by the upper end of the trimmer blade.

If the length of the stationary agitator 44 is set approximately equal to the length of the developing sleeve 32, the agitating action of the agitator 44 for the toner 62 can be exerted substantially uniformly along the overall length of the developing sleeve 32.

If the section of the stationary agitator 44 is formed into a circle, magnetic force lines are not concentrated in one place, so the magnetic carrier (magnetic brush) formed in the peripheral surface of the agitator 44 moves while changing its length and direction continually. Therefore, by disposing the stationary agitator 44 outside and near the rotation path of the first rotary agitator 33, the magnetic carrier can be brought inside the rotation path of the first rotary agitator 33 by the agitator 44.

As set forth above, according to the first aspect of the invention, in a developing unit including a developing chamber provided with a developing roller, the developing roller comprising a developing sleeve adapted to rotate while carrying a developer on the surface thereof and a magnet roller adapted to rotate on the inner diameter side of the developing sleeve; a first agitator means for agitating the developer which is a mixture of magnetic toner and a magnetic carrier in the developing chamber; and an agitation chamber provided with a second agitator means for supplying the magnetic toner to the developing chamber, there is used a restriction member formed of a magnetic material, the restriction member being mounted in a suspended state between the developing chamber and the agitation chamber so that an intermediate portion thereof is opposed to the peripheral surface of the developing roller in the developing chamber and a free end thereof extends toward the first agitator means.

In the above structure, even if magnetism acts on the restriction member in a position close to the surface of the developing sleeve with rotation of the magnet roller as a constituent of the developing roller, a magnetic field is not generated on the back side (the side opposed to the second agitator means) of the restriction member due to magnetic shielding because the restriction member is formed of a magnetic material. Thus, the magnetic toner which has previously adhered against the back of the restriction member under the action of the second agitator means will not adhere and stay there in the invention and the toner supplying operation, involving movement of the magnetic toner toward the first agitator means along the back of the restriction member, can be done positively and smoothly.

Consequently, the toner can be agitated together with the magnetic carrier by the first agitator means, and the toner-carrier mixing ratio can be maintained at a predetermined value, so that the quality of the image formed is stable.

Further, since the means for attaining such function and effect is the use of the restriction member formed of a magnetic material, such as pure iron, it is also possible to decrease the manufacturing cost.

According to the second aspect of the invention, in the developing unit according to the first aspect of the invention referred to above, the restriction member is formed in the shape of a plate and is mounted so that a wide surface thereof is positioned along and nearly in parallel with the peripheral surface of the developing roller.

Consequently, not only the foregoing function and effect attained by the developing unit according to the first aspect of the invention can be achieved but also the toner agitating action of the first rotary agitator can be exerted substantially uniformly throughout the overall length of the developing sleeve. Hence, there is no fear of unevenness of image in the longitudinal direction of the developing sleeve.

According to the third aspect of the invention, in the developing unit according to the first or second aspect of the invention referred to above, the spacing between the wide surface of the restriction member and the peripheral surface of the developing sleeve is set in such a manner that a magnetic brush of the magnetic carrier created by a magnetic field of the magnetic roller is not bridged on the wide surface of the restriction member and that the magnetic toner can be attracted to the surface of the developing sleeve.

Consequently, not only the function and effect attained by the developing unit according to the first or second aspect of the invention can be achieved, but also there does not occur the phenomenon that the magnetic brush of the magnetic carrier is bridged over both the surface of the developing sleeve and the surface of the restriction member because of a too narrow spacing between both surfaces and that the bridged position of the magnetic brush may be maintained constant and assume a stable state despite rotation of the developing sleeve. For this reason, there will not be formed a linear black line image in the rotating direction on the circumferential surface of the developing sleeve. It is also possible to eliminate the phenomenon that because of too wide spacing between the sleeve surface and the restriction member surface, where the free end of the restriction member is positioned radially outside the rotation path of the first rotary agitator, the influence of the magnetic field of the magnet roller no longer reaches the magnetic toner appropriately. In such a case, an appropriate amount of the magnetic toner is not attracted onto the surface of the developing sleeve and the image quality is deteriorated. Thus, due to the invention, it is possible to improve the image quality.

What is claimed is:

1. A developing unit, comprising:

a developing chamber provided with a developing roller, said developing roller comprising a developing sleeve adapted to rotate while carrying a developer on the surface thereof and a magnet roller adapted to rotate on the inner diameter side of said developing sleeve;

a first agitator for agitating the developer which is a mixture of toner and a magnetic carrier in said developing chamber; and an agitation chamber provided with a second agitator for supplying the toner to said developing chamber, wherein a restriction member is mounted at one end in a suspended state between said developing chamber and said agitation chamber so that an intermediate portion thereof is opposed to the peripheral surface of said developing roller in said developing chamber and an opposite, free end thereof extends toward said first agitator, wherein the free end of said restriction member is separated from a periphery of said first agitator by a distance of about 1 to 1.5 millimeters.

2. The developing unit according to claim 1, wherein said restriction member is formed in a shape of a plate and is mounted so that a wide surface thereof is positioned along and nearly in parallel with the peripheral surface of said developing roller.

3. The developing unit according to claim 2, wherein said restriction member is made of a magnetic material.

4. The developing unit according to claim 2, wherein a spacing between the wide surface of said restriction member and the peripheral surface of said developing sleeve is set in such a manner that a magnetic brush of the magnetic carrier created by a magnetic field of said magnet roller is not bridged on the wide surface of said restriction member and that the toner can be attracted to the surface of said developing sleeve.

5. The developing unit according to claim 4, wherein said restriction member is made of a magnetic material.

6. The developing unit according to claim 5, wherein said toner is a magnetic toner.

7. The developing unit according to claim 2, wherein a distance between the wide surface of said restriction member and the peripheral surface of said developing roller is in a range of 3 to 5 millimeters.

8. The developing unit according to claim 7, wherein the magnetic flux of said magnet roller is in a range of $7\times10^{-2}$ to $7.5\times10^{-2}$T, where T=Wb per $m^2$.

9. The developing unit according to claim 8, wherein said developing sleeve has a diameter of 16 millimeters.

10. The developer feeding system according to claim 1, further comprising a stationary agitator mounted in said developing chamber.

11. The developer feeding system according to claim 10, wherein said stationary agitator is made of a magnetic material, has a circular cross section and a longitudinal axis parallel to that of said magnet and developing rollers.

12. The developing unit according to claim 1, further comprising a stationary magnetic member mounted in said developing unit.

13. The developing unit according to claim 12, wherein said stationary magnetic member is a stationary magnetic agitator.

14. A developer feeding system for feeding a developer made up of toner and a magnetic carrier in a printing apparatus, comprising:

a developing case;

an agitation chamber in said developing case;

a developing chamber in said developing case;

a rotating shaft;

a magnet roller mounted on said shaft to rotate in a first direction;

a developing roller mounted coaxial with and radially outward of said magnet roller rotatable in a second direction opposite to the first direction; and a restriction member between said agitation chamber and said developing chamber, wherein the developer flows from said agitation chamber to said developing chamber through a slit formed between a free end of said restriction member and a wall portion of said developing case; and a stationary magnetic member mounted in said developing chamber.

15. The developer feeding system according to claim 14, wherein said restriction member is made of a magnetic material.

16. The developer feeding system according to claim 15, wherein said toner is a magnetic toner.

17. The developer feeding system according to claim 14, further comprising:

a first agitator in said developing chamber; and a second agitator in said agitation chamber.

18. The developer feeding system according to claim 17, wherein said first and second agitators are rotary agitators.

19. The developer feeding system according to claim 18, further comprising a trimmer blade, said trimmer blade mounted to said developing case and forming a downstream wall for said developing chamber.

20. The developer feeding system according to claim 17, wherein the magnet roller and developing roller have a coaxial longitudinal axis and said restriction member is a substantially planar structure parallel to the longitudinal axis.

21. The developer feeding system according to claim 20, wherein said restriction member has a height substantially equal to a diameter of said developing roller.

22. The developer feeding system according to claim 21, wherein said first agitator rotates thereby defining a rotation path and said free end of said restriction member is spaced outside of the rotation path by a predetermined distance.

23. The developer feeding system according to claim 21, wherein a portion of said restriction member proximate said free end is curved to be parallel to an outer peripheral surface of said developing roller.

24. The developer feeding system according to claim 23, wherein a distance between said developing roller and the curved portion of said restricting member parallel thereto is set to a second predetermined distance.

25. The developer feeding system according to claim 24, wherein said restriction member is made of a magnetic material.

26. The developer feeding system according to claim 14, wherein said stationary magnetic member functions as a stationary magnetic agitator, has a circular cross section and a longitudinal axis parallel to those of said magnet and developing rollers.

27. A developing unit, comprising:

a developing chamber provided with a developing roller, said developing roller comprising a developing sleeve adapted to rotate while carrying a developer on the surface thereof and a magnet roller adapted to rotate on the inner diameter side of said developing sleeve;

a first agitator for agitating the developer which is a mixture of toner and a magnetic carrier in said developing chamber;

an agitation chamber provided with a second agitator for supplying the toner to said developing chamber; and a stationary magnetic agitator mounted in said developing chamber.

* * * * *